US007833025B2

(12) United States Patent
Voli et al.

(10) Patent No.: US 7,833,025 B2
(45) Date of Patent: Nov. 16, 2010

(54) SEALED, SOLDERLESS I/O CONNECTOR

(75) Inventors: Edward Voli, East Setauket, NY (US); Frank Gong, Syosset, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 154 days.

(21) Appl. No.: 12/241,504

(22) Filed: Sep. 30, 2008

(65) Prior Publication Data

US 2010/0081309 A1 Apr. 1, 2010

(51) Int. Cl.
*H01R 12/00* (2006.01)

(52) U.S. Cl. ..... 439/76.1; 439/573; 439/79

(58) Field of Classification Search ..... 439/79, 439/573, 76.1, 363, 567, 953
See application file for complete search history.

(56) References Cited

U.S. PATENT DOCUMENTS 4,709,973 A * 12/1987 Waters et al. ..... 439/78
5,194,010 A * 3/1993 Dambach et al. ..... 439/79
5,451,158 A * 9/1995 Lin et al. ..... 439/79
5,876,220 A 3/1999 Yeh
6,383,010 B1 * 5/2002 Mayo et al. ..... 439/357
6,663,425 B1 * 12/2003 Zhang et al. ..... 439/607.35
7,438,582 B2 * 10/2008 Taylor ..... 439/342
2002/0115344 A1 8/2002 Chen
2006/0128213 A1 6/2006 Higeta et al.

FOREIGN PATENT DOCUMENTS

EP 0509380 10/1992
WO 2010068322 6/2010

OTHER PUBLICATIONS

International Search Report and Written Opinion dated Jan. 11, 2010 in related case PCT/US2009/057676.

* cited by examiner

*Primary Examiner*—Xuong M Chung Trans

(57) ABSTRACT

A sealed, solderless I/O connector for allowing the connection of cables or desk accessories to a mobile communication device while providing a weather tight seal allowing the use of the mobile communication device outdoors. The sealed, solderless I/O connector provides for greater tolerance of mechanical stress due to vibration or dropping because the contact points between the connector and the printed circuit board accomplished with a "U" shaped spring contact. The sealed, solderless I/O connector also provides a locking mechanism to prevent unintended detachment of the cable or desk accessory.

22 Claims, 6 Drawing Sheets

SEALED, SOLDERLESS I/O CONNECTOR

TECHNICAL FIELD

The subject invention relates generally to communication devices, and more particularly to connectors attached to circuit boards for connecting cables to communication devices.

BACKGROUND

Communication devices such as cellular telephones have become a necessary tool carried by almost every member of modern society. The portable nature of the device has led to a market trend to make the device smaller and therefore less cumbersome to carry no matter what the dress or situation. The miniaturization of the device has continued on all fronts, including connectors for attaching cables to the communication device such as for providing power to recharge the batteries in the mobile device or connect the mobile device to other computing resources.

A combination of the miniaturization of the communication device and its associated connectors and the heavy cycles of use associated with a device that is used everyday therefore requiring continuous attachment and detachment of the external cables to the connectors has exposed a problem in the design of the connectors. Connectors are traditionally attached to the circuit boards by a soldered connection. Although the soldered connection facilitates a good electrical connection for the transmission of current for recharging or communication signals, the smaller size of the connectors and the frequency of use have produced systemic problems of failure of the connectors because of the mechanical stresses associated with attaching and removing the cable from the connector.

Once a connector has failed, usually resulting in a break of one or more of the soldered connections, the communication device is only viable until the current battery charge is depleted. Attempting to repair a connector is not feasible by the end user and the expense of returning the communication device for repair is usually prohibitive because replacing the connector requires replacing the connector and the attached circuit board. In some cases repair is not possible because of the design of the communication device and a new communication device must be purchased as a replacement.

This scenario is upsetting to the communication device user because the communication device can fail in this manner after relatively little use because of an errant force exerted on the connector because the user became entangled in the cable and pulled to hard while the cable was connected to the communication device. In this scenario, the communication device still operates as intended but its useable life is now limited by the amount of charge remaining in the battery.

Market demand has created the requirement for smaller communication devices with a connector capable of withstanding the greater cycles of use and errant forces associated with a device that is used on a continuous basis. In another aspect, market pressure is also demanding connectors more tolerant of high moisture conditions. The connector is expected to survive the everyday spill of a liquid, such as a cup of coffee, or the splashing of raindrops so attaching the cable to the connector after one of these types of events does not produce an electrical short capable of destroying the device because the fluid was able to reach the circuit board from the connector access port.

SUMMARY

The following presents a simplified summary in order to provide a basic understanding of some aspects described herein. This summary is neither an extensive overview nor is intended to identify key/critical elements or to delineate the scope of the various aspects described herein. Its sole purpose is to present some concepts in a simplified form as a prelude to the more detailed description presented later.

The subject innovation includes an injection molded connector body containing connector terminals sealed into the connector body, an injection molded connector lock containing threaded retainers for sandwiching the connector terminals between the connector lock and the connector mating pads located on the printed circuit board and connector screws for securing the connector lock, connector body and printed circuit board together. The connector does not require soldering because the tension created between the connector terminals and the connector mating pads by tightening the connector screws provides sufficient contact to close the electrical circuit between the connector terminals and the connector mating pads. The subject innovation also allows the connector to flex under external forces produced by the user while connecting and disconnecting cables or by stress induced by dropping the communication device containing the connector.

In another aspect of the subject innovation, the connector's injection molded design of molding the connector terminals into the connector body provides a sufficiently water tight connector to allow the use of the connector in outdoor communication devices. In another aspect, the connector incorporates two locking features for positively maintaining a connection to an attached cable or desk accessory. As with the connector terminals, the locking mechanism is also molded into the connector body to provide a durable and watertight seal.

To the accomplishment of the foregoing and related ends, certain illustrative aspects are described herein in connection with the following description and the annexed drawings. These aspects are indicative of various ways which can be practiced, all of which are intended to be covered herein. Other advantages and novel features may become apparent from the following detailed description when considered in conjunction with the drawings.

DETAILED DESCRIPTION

Figure 1:
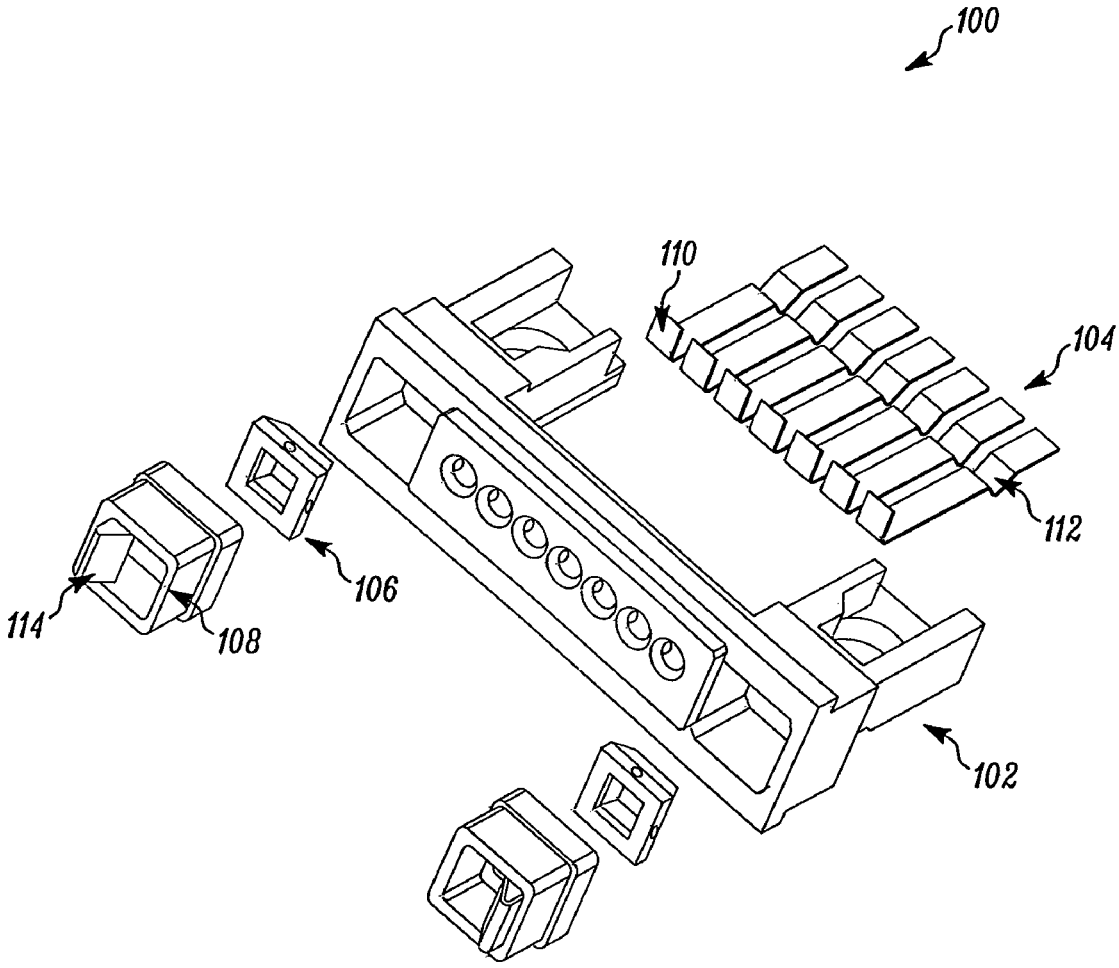
FIG. 1 illustrates an embodiment of the components of a sealed, solderless I/O connector body including the connector housing, connector terminals, connector cap and connector retainer.

Systems and methods are provided enabling the attachment of a connector to a printed circuit board and creating an electrical connection without the use of solder. The design and assembly of the connector also provides a water and dust resistant barrier allowing the connector's use in outdoor applications where water or dust can be of sufficient magnitude to prohibit the use of other connectors without this barrier. The solderless design of the connector provides a greater level of resistance to shock and vibration because there are no soldered connections between the connector and the printed circuit board. The solderless design also provides for the easy replacement of the connector should the connector become damaged from external forces or use. The simple removal of two screws allows for the connector's removal and replacement.

In one aspect of the subject disclosure, the sealed, solderless I/O connector increases the useful life of the mobile communications device by providing a connector with a greater resistance to abuse by the user. For example, the design of the connector intends for the user to insert the cable for charging the battery in a direction parallel and on axis with the insertion pins of the cable. The user does not always insert the cable as directly as possible and in some cases, flexes the cable and the connector to a point of cracking soldered connections in the process.

It should be noted that although useful for describing the invention, the subject innovation is not limited to mobile communication devices. The sealed, solderless I/O connector is equally applicable to any computing device, mobile or stationary. It should also be noted that although useful for describing the subject invention, the sealed, solderless I/O connector is not limited to connecting cables to a computing device. The sealed, solderless I/O connector is applicable to any external connection to the computing device requiring an electrically conductive connection capable of withstanding repetitive attachment and detachment of a harsh nature. Examples of a harsh nature of attachment or detachment include not only severe flexing of a connected cable but also include "angry" slamming of a mobile computing device into a charge cradle or dropping the mobile computing device in a manner where it lands on the sealed, solderless I/O connector.

As used herein, cradle accessory includes but is not limited to wall mount charge/communication cradles, vehicle charge/communication cradles and forklift charge/communication cradles. The term cradle accessory is intended to reflect an external connection from an electrically conductive device to the sealed, solderless I/O connector attached to the printed circuit board of the mobile computing device In another example, after connecting the cable the user can accidently become entangled in the cable, drop the mobile communication device or even forget the mobile communication device is connected to the cable while using the mobile communication device and move a sufficient distance to reach the limits of the cable length and apply sufficient force perpendicular to the axis of insertion to break the soldered connection between a soldered connector and a printed circuit board.

The subject innovation allows the mobile communication device to be much more tolerant of these common scenarios. In one aspect, because the connector is not soldered to the printed circuit board, a greater amount of connector flexing is permitted because there are no soldered connections to fracture. In another aspect, if sufficient force is applied to break the connector then the connector is easily replace because the removal of two screws allows the connector's removal without the difficult and sometimes damaging step of removing solder to free the connector from the printed circuit board.

As used herein, the term to "infer" or "inference" refer generally to the process of reasoning about or inferring states of the system, environment, user, and/or intent from a set of observations as captured via events and/or data. Captured data and events can include user data, device data, environment data, implicit and explicit data, etc. Inference can be employed to identify a specific context or action, or can generate a probability distribution over states, for example. The inference can be probabilistic, that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

Referring initially to FIG. 1, an exploded view of connector body 100 of a sealed, solderless I/O connector for a mobile communication device is depicted. The connector body is comprised of a connector housing 102, a plurality of connector terminals 104, a plurality of connector caps and a plurality of connector retainers. In one aspect of the subject innovation, the connector body 100 includes one connector housing 102 insert molded with seven connector terminals 104, two connector caps 106 and two connector retainers 108.

In one aspect of the subject innovation, the connector terminals 104, connector caps 106 and connector retainers 108 are all insert molded into the connector housing 102. This process provides a connector body that is sufficiently rigid and structurally stable to allow a secondary function as an internal mounting bracket. For example, an antenna or a microphone can be mounted to the installed sealed, solderless I/O connector by molding, clamping or screwing the component to the connector body.

In another aspect of the subject innovation illustrated by FIG. 1, the insert molded nature of the assembly of the connector housing 102, connector terminals 104, connector caps 106 and connector retainers 108 provides a weather tight seal sufficiently water and dust tight to allow a user to operate a mobile communication device employing the sealed, solderless I/O connector outdoors without the fear of damaging the mobile communication device by the infiltration of moisture or dust particles through the external connector.

In another aspect of the subject innovation, the connector housing 102 is molded from a liquid crystal polymer material suitable for injection molding. The U shaped design of the connector housing 102 provides for an orientation of the cable connection point at the base of the U in a direction parallel to the plane of the printed circuit board 212 and extending off the end of the printed circuit board 212. The ends of the U shaped connector housing are injection molded with holes for the passage of screws through holes 214 in the printed circuit board 212 the connector housing 102 and into the threaded holes on the connector lock 208.

FIG. 1 illustrates another aspect of the subject innovation at the connector terminals 104. The connector terminals 104 are constructed of a conductive material suitable for withstanding the stress of sandwiching the connector terminals between the connector mating pads 206 and the connector lock 208 and for repetitive stress generated by the continual insertion and removal of the external cable. For example, in one manufacture, the connector terminals can be constructed of an alloy of beryllium and copper suitable for use in electrically conductive applications. The connector terminals 104 are insert molded into the connector housing 102.

In one aspect of the subject invention, the connector terminals are L shaped 110 in design with approximately ten percent of the length of each terminal bent to approximately a ninety degree angle forming an L shape 110. The L shaped 110 bend in the connector terminal is the contact point between the connector terminal and the pin inserted with by the cable attaching to the sealed, solderless I/O connector.

In another aspect of the subject innovation, approximately two thirds of the way from the L shaped 110 bend towards the opposite end of the connector terminal, a U shape 112 is formed in the connector terminal in a direction opposite to the direction of the L shaped 110 bend. The U shaped 112 bend in the connector terminal is the contact point between the connector terminal and the connector mating pad 206 located on the printed circuit board 212. It should be noted that the width of the connector housing and the number of connector terminals can vary with the requirements of the application and manufacturing.

In another aspect of the subject innovation, connector caps 106 are insert molded into the connector housing 102. The connector caps are manufactured from a liquid crystal polymer material suitable for injection molding. The connector caps 106 are inserted in the connector housing to provide a stable mounting position for the connector retainers and to provide a seal against moisture and dust attempting to infiltrate the mobile communication device through the sealed, solderless I/O connector.

In another aspect of the subject innovation, connector retainers 108 are insert molded into the connector housing 102. The connector retainers 108 are manufactured from a liquid crystal polymer suitable for injection molding and include a zinc alloy retaining clip 114 for securely attaching a cable or desk accessory. The connector retainers are placed over the connector caps 106 in the assembly. The connector retainers 108 provide a locking mechanism by including a spring like retaining clip 114 for positively securing the cable or desk accessory to the sealed, solderless I/O connector.

Figure 2:
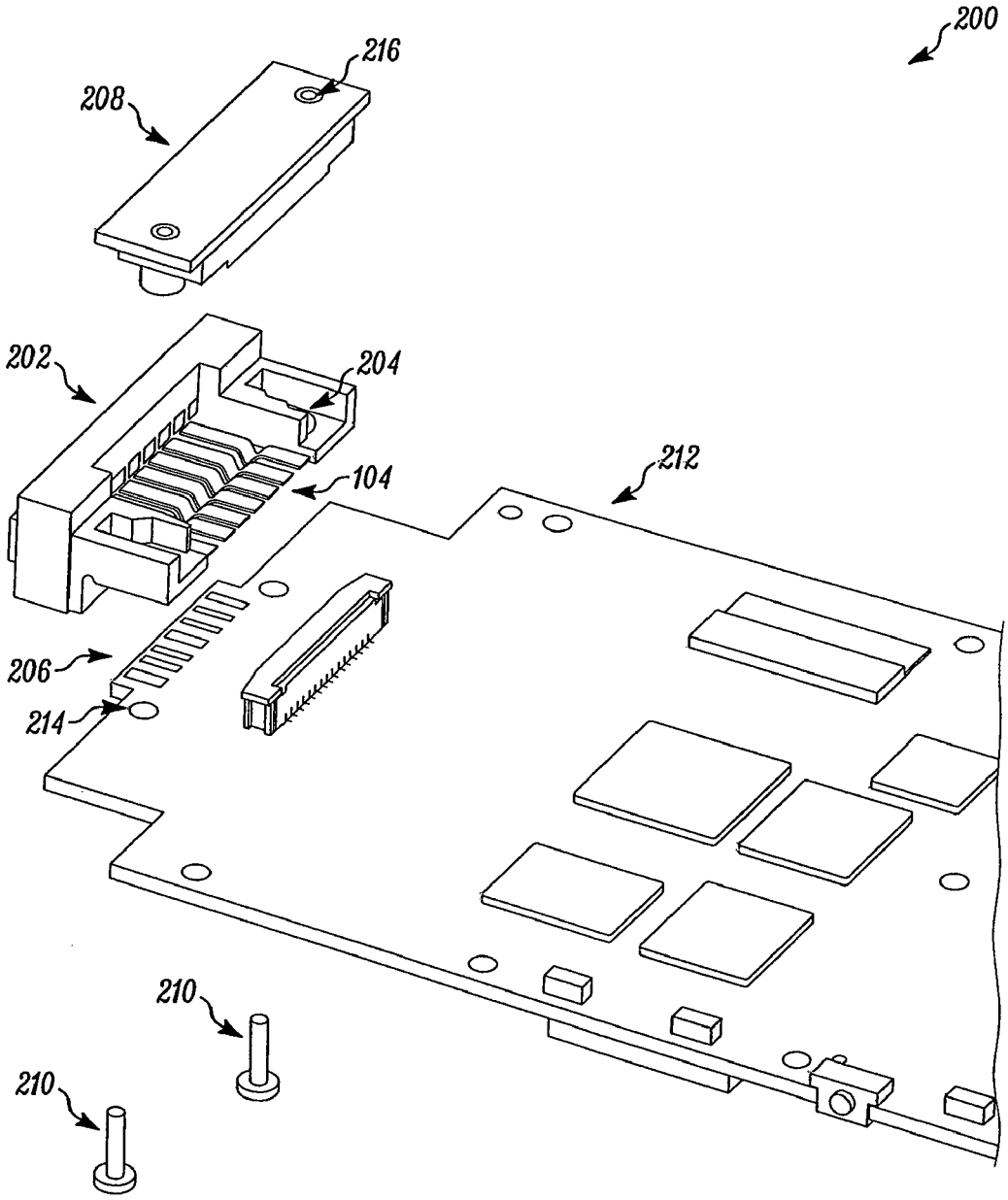
FIG. 2 illustrates an embodiment of the components of a sealed, solderless I/O connector including the connector lock, connector body, printed circuit board with connector mating pads and the connector screws.

Referring next to FIG. 2, an exploded view 200 of a sealed, solderless I/O connector is illustrated. The sealed, solderless I/O connector comprises a connector body 202, a connector lock 208 and connector screws 210 to secure the components to the printed circuit board 212. The connector body 202 is place against the side of the printed circuit board with the connector mating pads 206. When the holes 204 in the arms of the connector body 202 are aligned with the holes 214 in the printed circuit board 212, the connector terminals 104 will align with the connector mating pads 206 on the printed circuit board 212. The connector lock 208 then applies force on the connector terminals 104 securing them against the connector mating pads 206 with sufficient force to create a reliable connection. The connector lock 208 has a ridge running lengthwise along the longer dimension of the connector lock 208 on the side inserted into the connector body 202 for applying the force necessary to sufficiently compress the connector terminals 104 against the connector mating pads 206. The connector lock 208 is held in this position by the connector screws 210 inserted from the opposite side of the printed circuit board 212 and screwed into the threaded retainers 216 on the connector lock 208.

Figure 3:
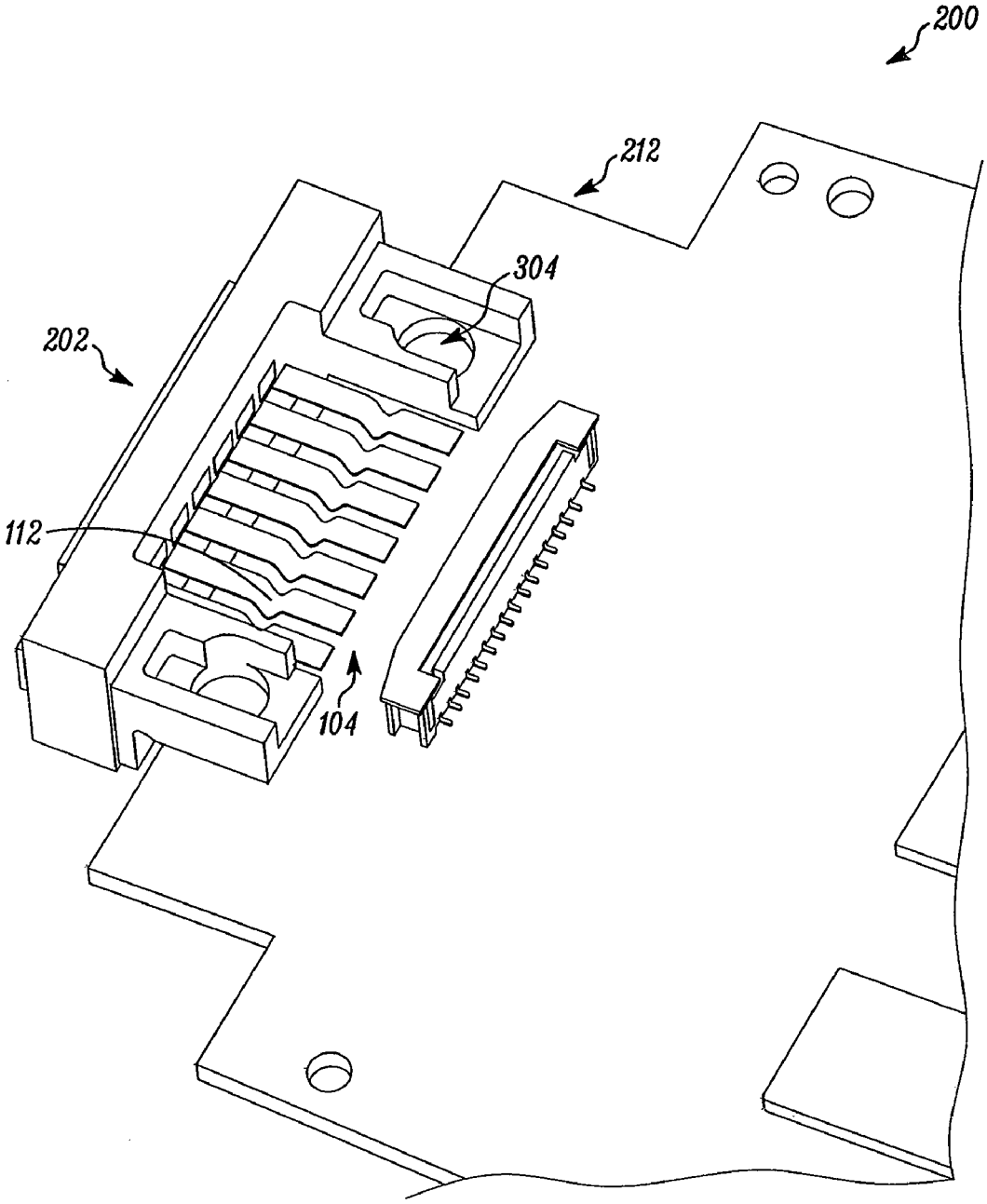
FIG. 3 illustrates an embodiment of a sealed, solderless I/O connector body adjacent to a printed circuit board with the connector terminals contacting the connector mating pads.

Referring next to FIG. 3, a cutaway view of the connector body 202 attached to the printed circuit board 212 is illustrated. In one aspect of the subject innovation, the connector terminals 104 are in contact with the connector mating pads 206 at the "U" shaped bend 112 in the connector terminals 104. In another aspect, the holes in the connector body 202 are aligned with the connector mounting holes 214 in the printed circuit board 212. Once the mounting holes are aligned, the connector terminals 104 are also aligned with and directly over the connector mating pads 206.

In another aspect of the subject innovation, after final assembly, including attaching the connector lock 208 over the connector terminals 104 with the connector screws 210, it is evident that the electrical connection created between the connector terminals 104 at the "U" shaped 112 bend and the connector mating pads 206 is stable. If a substantial force is applied to the connector, as in an accidental drop of the mobile communication device, the contact points between the connector terminals 104 and the connector mating pads 206 simply roll on the "U" shaped 112 bend in the connector terminals 104 on the connector mating pads 206. The contact point between the connector terminals 104 and the connector mating pads 206 does not have a rigid solder connection that would be susceptible to fracture under the described stress.

Figure 4:
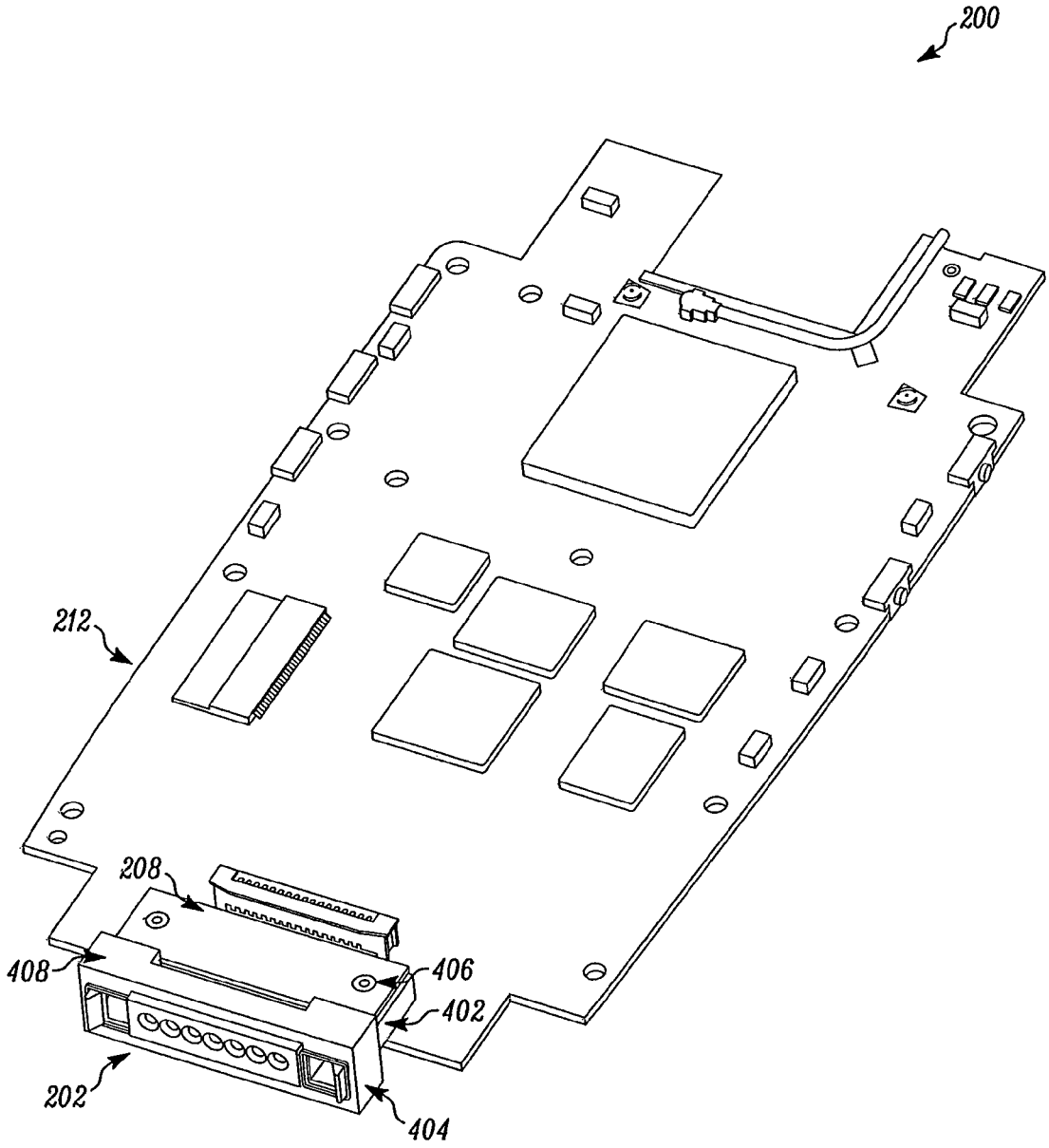
FIG. 4 illustrates an embodiment of a sealed, solderless I/O connector assembly attached to a printed circuit board, including the locking features of the connector.

Referring next to FIG. 4, a sealed, solderless I/O connector body 202 attached to a printed circuit board 212 is illustrated. In one aspect of the subject innovation, the connector lock 208 maintains constant pressure on the connector terminals 104 as a result of tightening the connector screws 210 into the threaded receivers 406 molded into the connector lock 208. The flat surface of the connector body 202 adjacent to the printed circuit board 212 provides a stable platform to minimize the ability of the connector body 202 to move and release the pressure applied by the connector lock 208 on the connector terminals 104. The remaining ability of the connector body 202 to flex under stress has no effect on the electrical connection between the connector terminals 104 and the connector mating pads 206 because the connector terminals 104 are not soldered to the connector mating pads 206. In another aspect of the subject innovation, the retaining clips 404 provide for a positive locking connection between the connector body 202 and the attached cable or cradle accessory. In another aspect, the flat rectangular area 408 of the connector body provides a uniform and easily sealed mating area for the mobile device case to attach to the connector body 202 to prevent the intrusion of moisture or dust particles.

Figure 5:
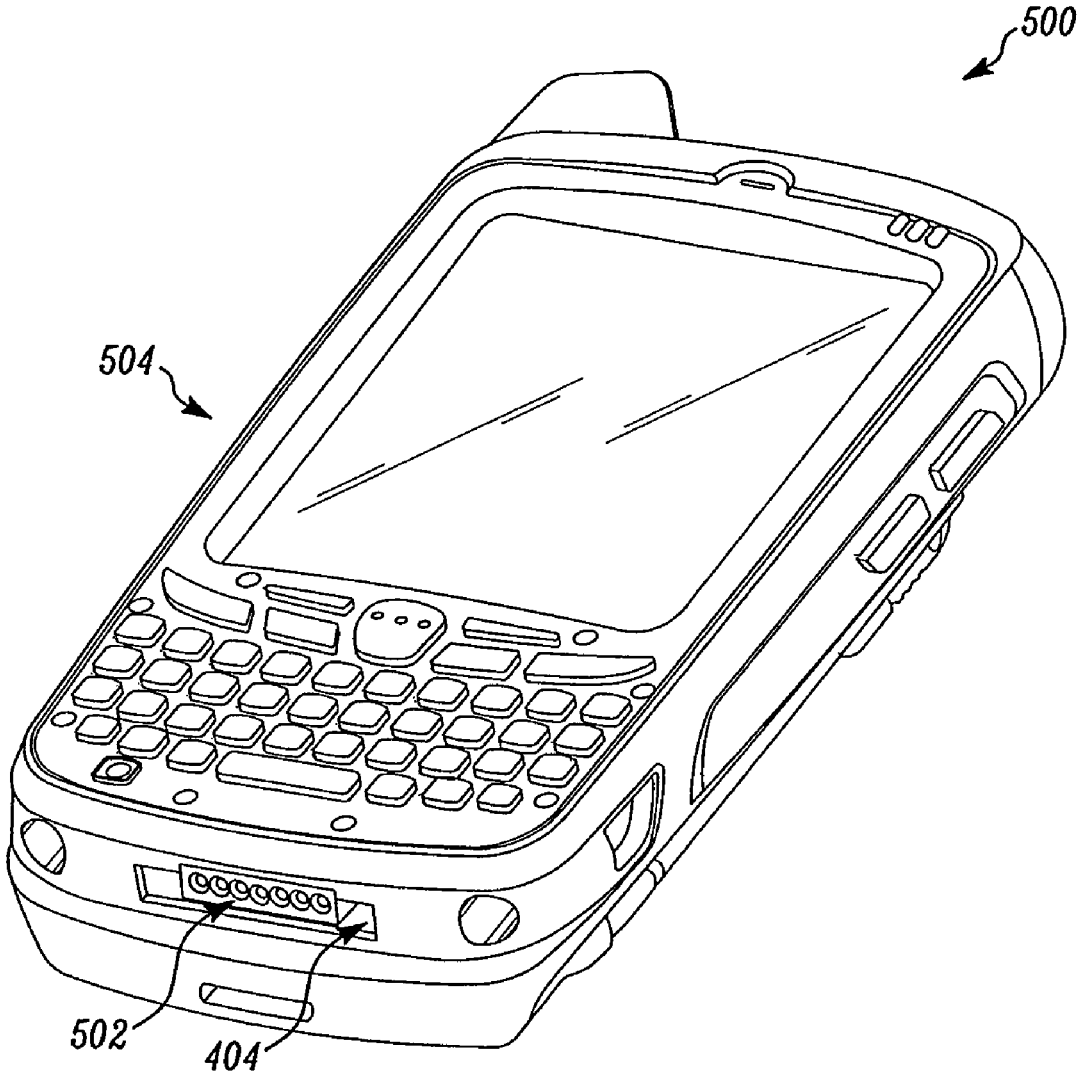
FIG. 5 illustrates an embodiment of a sealed, solderless I/O connector assembly attached to a printed circuit board and installed in a typical mobile communication device.

Referring now to FIG. 5, a typical mobile communication device 500 is illustrated with a sealed, solderless I/O connector 502 installed. The design of the printed circuit board 212 (FIG. 4) and the mobile communication device case 504 creates a flush mounting arrangement for the sealed, solderless I/O connector 502. It should be noted that although the representation of the sealed, solderless I/O connector 502 illustrates seven contacts, the sealed, solderless I/O connector can have a fewer or a greater number of contacts resulting in a narrower, wider or stacked arrangement of contacts. The sealed, solderless I/O connector 502 is shown with the optional retaining clips 404.

Figure 6:
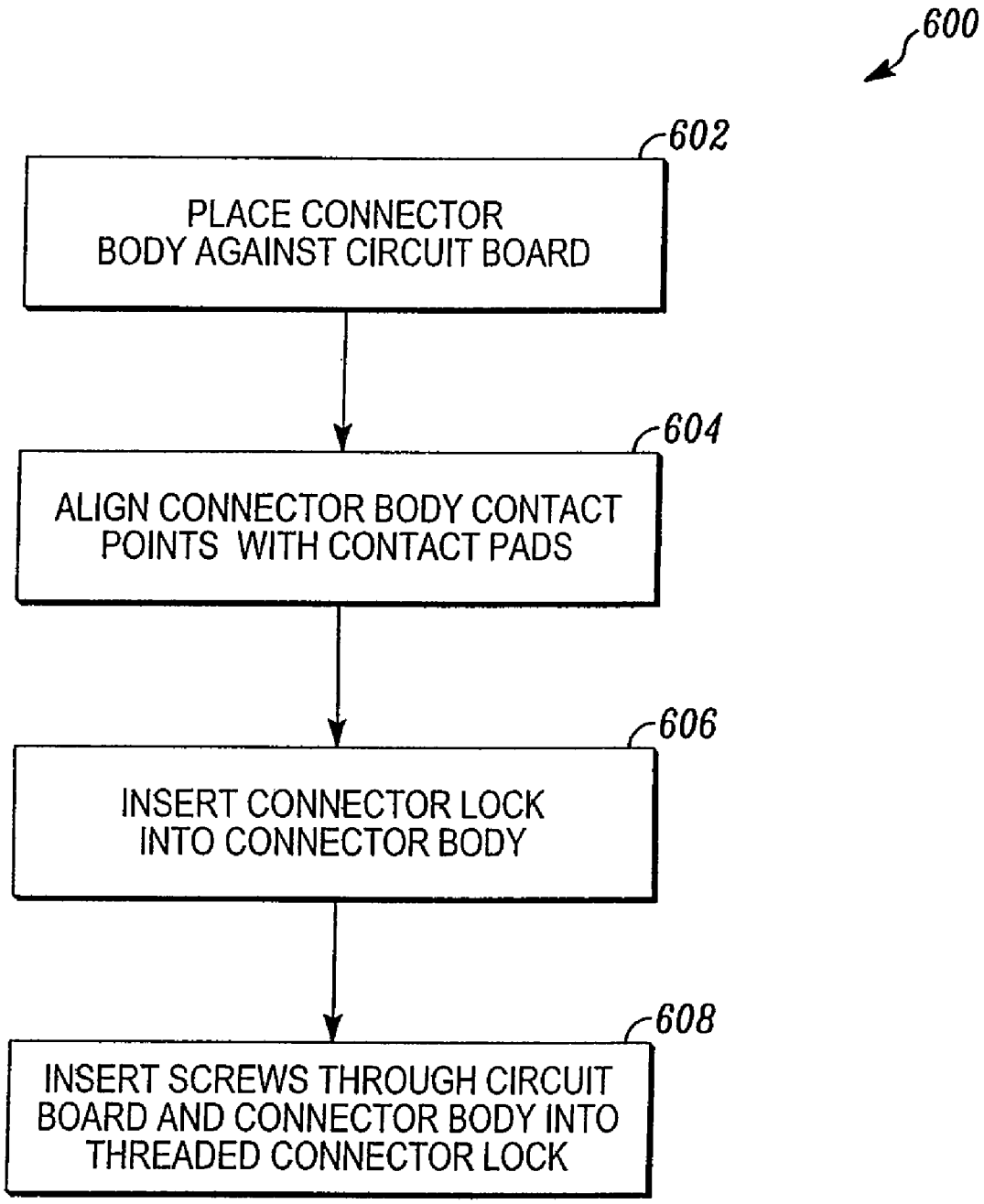
FIG. 6 illustrates a methodology of attaching a sealed, solderless I/O connector assembly to a printed circuit board.

Referring now to FIG. 6, a method 600 of attaching a sealed, solderless I/O connector to a printed circuit board 212 is described. In one aspect of the method beginning at step 602, a connector body 202 is placed against the printed circuit board. The connector body 202 is placed on the side of the printed circuit board 212 containing the connector mating pads 206. The connector body 202 is oriented so the connector terminals 104 contact the connector mating pads 206.

In another aspect of the subject method 600 illustrated at step 604, the connector terminals 104 are aligned with the connector mating pads 206 by aligning the attachment holes 204 in the connector body 202 with the mounting holes 214 in the printed circuit board 212.

In another aspect of the subject method 600 illustrated at step 606, the connector lock 208 is inserted into the connector body 202 above the connector terminals 104. The connector lock 208 will sandwich the connector terminals 104 against the connector mating pads 206 on the printed circuit board 212. The connector lock form fits into a slot at the rear of the connector body 202 and over the attachment holes 204 in the connector body 202. A ridge formed in the connector lock 208 the width of the connector terminals 104 applies sufficient force on the connector terminals 104 at a position near the end of the connector terminals 104 opposite the "L" shaped bend to maintain a stable electrical connection between the connector terminals 104 and the connector mating pads 206 located on the printed circuit board 212.

In another aspect of the subject method 600 illustrated at step 608, the connector screws 210 are inserted through the holes 214 in the printed circuit board from the side opposite the side adjacent to the connector body 202. The connector screws 210 continue through the holes in the connector housing 102 and into the threaded receivers in the connector lock 208. The connector screws 210 are then tighten to a sufficient torque to compress the connector lock 208 against the connector housing 102 and therefore compressing the connector terminals 104 against the connector mating pads 206.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and that any one or more middle layers, such as a management layer, may be provided to communicatively couple to such sub-components in order to provide integrated functionality. Any components described herein may also interact with one or more other components not specifically described herein but generally known by those of skill in the art.

In view of the exemplary systems described above, methodologies that can be implemented in accordance with the described subject matter will be better appreciated with reference to the flowcharts of the various figures. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described herein. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

In addition to the various embodiments described herein, it is to be understood that other similar embodiments can be used or modifications and additions can be made to the described embodiment(s) for performing the same or equivalent function of the corresponding embodiment(s) without deviating therefrom. Accordingly, no single embodiment shall be considered limiting, but rather the various embodiments and their equivalents should be construed consistently with the breadth, spirit and scope in accordance with the appended claims.

While, for purposes of simplicity of explanation, the methodology is shown and described as a series of acts, it is to be understood and appreciated that the methodology is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology as described herein.

What is claimed is:

1. A sealed, solderless I/O connector for facilitating the connection of a cable or a desk accessory to an electronic device, the apparatus comprising:

a plurality of electrically conductive connector terminals for making electrical connections with the cable contacts or cradle accessory contacts on one end and with connector mating pads on a printed circuit board on the other end, the connector terminals having a first L-shaped bend on one end for facilitating an electrical connection with a cable contact or a cradle accessory contact and having a second U-shaped bend in a direction opposite the first L-shaped bend and a tail extending at the U-shaped bend for facilitating an electrical connection with contacts on a printed circuit board;

a plurality of connector caps for providing a base to mount a plurality of connector retainers;

a plurality of connector retainers for providing a locking mechanism for attached cables or cradle accessories;

a connector housing for assembling the connector terminals, connector caps and connector retainers into a connector body assembly;

a connector lock with threaded receivers for securely attaching the connector body to the printed circuit board; and a plurality of connector screws for securing the connector lock to the printed circuit board by passing the connector screws through holes in the printed circuit board and connector body and threading the connector screws into the threaded receivers in the connector lock, wherein a tension created between the connector terminals and connector mating pads upon securing the connector lock to the printed circuit board using the plurality of connector screws closes an electrical circuit between the connector terminals and the connector mating pads.

2. The apparatus of claim 1, the connector terminals are comprised of an alloy of beryllium and copper suitable for electrically conductive applications.

3. The apparatus of claim 1, the first L-shaped bend bend on one end of about ten percent of the total length to an angle of about ninety degrees for facilitating an electrical connection with a cable contact or a cradle accessory contact.

4. The apparatus of claim 1, the first bend ends of the connector terminals are insert molded into the connector housing forming a contamination resistant seal.

5. The apparatus of claim 4, the contamination resistant seal facilitates the prevention of moisture and dust particles from entering the electronic device through the connector terminals.

6. The apparatus of claim 1, the second U-shaped bend bend of about ten percent of the length of the connector terminal in a direction opposite the first bend beginning about the center of the remaining length of the connector terminal and forming the "U" shape in a direction away from the first bend.

7. The apparatus of claim 1, the connector caps are insert molded into the connector housing forming a contamination resistant seal.

8. The apparatus of claim 7, the contamination resistant seal facilitates the prevention of moisture and dust particles from entering the electronic device through the connector caps.

9. The apparatus of claim 1, the connector retainer locking mechanism further comprises a locking clip for securely attaching a cable or cradle accessory to the connector.

10. The apparatus of claim 9, the locking clips are insert molded into the connector retainer forming a contamination resistant seal.

11. The apparatus of claim 9, the locking clips are comprised of a zinc alloy suitable for the mechanical stress of repetitive flexing during locking and unlocking.

12. The apparatus of claim 1, the connector retainers are insert molded into the connector housing forming a contamination resistant seal.

13. The apparatus of claim 12, the contamination resistant seal facilitates the prevention of moisture and dust particles from entering the electronic device through the connector retainers.

14. The apparatus of claim 1, the connector lock further comprises a ridge running lengthwise along the longer dimension of the connector lock for compressing the connector terminals against the connector mating pads.

15. The apparatus of claim 14, the ridge compresses the connector terminals at a position along the end of the connector terminals opposite the end with the first bend.

16. The apparatus of claim 1, the connector caps, connector retainers, connector housing and connector lock are comprised of a non-conductive material.

17. The apparatus of claim 16, the non-conductive material is comprised of a liquid crystal polymer suitable for injection molding.

18. A method of creating a sealed, solderless connection on a printed circuit board for a mobile communication device, the method comprising:

placing a connector body having connector terminals on a printed circuit board adjacent to the printed circuit board connector body mounting holes and the connector mating pads, the connector terminals having a first L-shaped bend on one end for facilitating an electrical connection with a cable contact or a cradle accessory contact and having a second U-shaped bend in a direction opposite the first L-shaped bend and a tail extending at the U-shaped bend for facilitating an electrical connection with the connector mating pads;

aligning the connector mounting holes in the connector body and the printed circuit board;

inserting a connector lock into the Connector body and compressing the connector terminals against the connector mating pads; and inserting the connector screws from the side opposite the connector body through the printed circuit board and the connector body and into the threaded receivers in the connector lock to securely attach the connector body to the printed circuit board.

19. A sealed, solderless I/O connector, the apparatus comprising:

means for making electrical connections using electrical connectors with a cable or desk accessory on one end and with connector mating pads on a printed circuit board on the other end, the electrical connectors having a first L-shaped bend on one end for facilitating an electrical connection with the cable or desk accessory and having a second U-shaped bend in a direction opposite the first L-shaped bend and a tail extending at the U-shaped bend for facilitating an electrical connection with the connector mating pads;

means for providing a base to mount a plurality of connector retainers;

means for providing a locking mechanism for attached cables or desk accessories;

means for assembling the electrical connectors, the base and the locking mechanism;

means for securely attaching the connector to the printed circuit board; and means for closing an electrical circuit between the cable or desk accessory on the one end and the connector mating pads on the printed circuit board.

20. The apparatus of claim 19, further comprising means for attaching additional components.

21. The apparatus of claim 19, further comprising means for aligning the connector with the printed circuit board.

22. The apparatus of claim 19, further comprising means for sealing the connector to a mobile communication device case.

* * * * *

UNITED STATES PATENT AND TRADEMARK OFFICE

CERTIFICATE OF CORRECTION

PATENT NO. : 7,833,025 B2
APPLICATION NO. : 12/241504
DATED : November 16, 2010
INVENTOR(S) : Voli et al.

It is certified that error appears in the above-identified patent and that said Letters Patent is hereby corrected as shown below:

1. In Column 3, Line 53, delete “device” and insert -- device. --, therefor.

2. In Column 9, Line 4, in Claim 3, delete “bend bend” and insert -- bend --, therefor.

3. In Column 9, Lines 15-16, in Claim 6, delete “bend bend” and insert -- bend --, therefor.

Signed and Sealed this
Fifteenth Day of May, 2012

David J. Kappos

David J. Kappos
*Director of the United States Patent and Trademark Office*